US010563654B2

(12) United States Patent
Ott et al.

(10) Patent No.: US 10,563,654 B2
(45) Date of Patent: Feb. 18, 2020

(54) PUMP-MOTOR COMBINATION HAVING A SINGLE COMMON ROTOR SHAFT

(71) Applicant: ebm-papst St. Georgen GmbH & Co. KG, St. Georgen (DE)

(72) Inventors: Tobias Ott, Balingen (DE); Alexander Hahn, Eigeltingen-Heudorf (DE)

(73) Assignee: ebm-papst St. Georgen GmbH & Co. KG, St. Georgen (DE)

( * ) Notice: Subject to any disclaimer, the term of this patent is extended or adjusted under 35 U.S.C. 154(b) by 389 days.

(21) Appl. No.: 14/970,780

(22) Filed: Dec. 16, 2015

(65) Prior Publication Data

US 2017/0097001 A1 Apr. 6, 2017

(30) Foreign Application Priority Data

Oct. 5, 2015 (DE) ..... 20 2015 105 244 U

(51) Int. Cl.
*F04C 15/00* (2006.01)
*F04C 2/10* (2006.01)

(52) U.S. Cl.
CPC ..... *F04C 15/0065* (2013.01); *F04C 2/102* (2013.01); *F04C 15/008* (2013.01); *F04C 15/0076* (2013.01); *F04C 15/0088* (2013.01); *F04C 2240/40* (2013.01); *F04C 2240/52* (2013.01); *F04C 2240/56* (2013.01); *F04C 2240/60* (2013.01); *F04C 2240/809* (2013.01)

(58) Field of Classification Search
CPC ..... F04C 15/0065; F04C 15/008; F04C 15/0076; F04C 2240/40; F04C 2240/60; F04C 2240/50; F04C 2240/52; F04C 2240/56; F04C 2240/809; F04C 2/00; F04C 2/10; F04C 2/08; F04C 14/06; F04C 15/0057; F04C 15/0061
See application file for complete search history.

(56) References Cited

U.S. PATENT DOCUMENTS 4,598,583 A * 7/1986 Steinhauser ..... G01F 15/14 73/202
6,206,667 B1 * 3/2001 Turner, Jr. ..... F04C 2/082 417/218
2005/0152790 A1 * 7/2005 Arbogast ..... F04B 17/03 417/356

(Continued)

*Primary Examiner* — Bryan M Lettman
*Assistant Examiner* — Timothy P Solak
(74) *Attorney, Agent, or Firm* — Dickinson Wright PLLC

(57) ABSTRACT

A pump-motor combination includes a motor (30) and a pump (20). The pump has a first rotor (21) and a first housing 300). The motor is an electric motor (30) having a second rotor (31), a stator (33) and a second housing (32). The first (pump) rotor (21) is at least partially coupled, and the second (motor) rotor (31) is completely coupled, to a common rotating shaft (40) in order to enable transmission of rotation of the second (motor) rotor (31) to the first (pump) rotor (21). The pump-motor combination can be installed with the gearbox (G) or transmission of a motor vehicle, to assure supply of lubricant (360) when a primary lubricant pump (350) has not been operating, for example, upon start-up. Use of the common shaft (40) minimizes frictional losses during operation and reduces the cost of manufacture, since fewer bearings are needed.

20 Claims, 4 Drawing Sheets

(56) References Cited

U.S. PATENT DOCUMENTS

| | | | | |
|---|---|---|---|---|
| 2005/0265860 | A1* | 12/2005 | Kameya | F04C 2/086 417/410.4 |
| 2006/0222527 | A1* | 10/2006 | Kurita | F04C 14/26 417/410.1 |
| 2007/0182259 | A1* | 8/2007 | Sakata | F04C 15/008 310/90 |
| 2009/0142208 | A1* | 6/2009 | Rhein | F04C 2/102 417/410.3 |
| 2010/0296950 | A1* | 11/2010 | Kataoka | F04B 39/0238 417/410.1 |
| 2011/0135516 | A1* | 6/2011 | Oishi | F01C 21/02 417/410.4 |
| 2012/0128513 | A1* | 5/2012 | Sakata | F04C 2/086 417/410.1 |
| 2013/0052058 | A1* | 2/2013 | Motohashi | F01C 21/02 417/410.4 |
| 2013/0183175 | A1* | 7/2013 | Irie | F04C 2/102 417/410.4 |

* cited by examiner

PUMP-MOTOR COMBINATION HAVING A SINGLE COMMON ROTOR SHAFT

CROSS-REFERENCE TO RELATED APPLICATION(S)

This application claims priority from German Utility Model application 20 2015 105 244.8 filed 2015 Oct. 5 by ebm-papst St. Georgen GmbH & Co KG.

FIELD OF THE INVENTION

The invention relates generally to a pump-and-motor unit and, more particularly, to a structure in which the pump and an electric motor have a common shaft, so that the pump is driven by the electric motor in accordance with electronic control signals.

BACKGROUND

Pump-motor units are used, particularly in the motor vehicle field, for feeding of hydraulic fluids, particularly of lubricating oil or fuel. A rotor of the pump, which conveys the fluid from the tank and compresses it, is driven by a motor, usually an electric motor. A shaft of the electric motor is connected to a rotor of the pump, in order to drive the pump. For this purpose, generally the shaft of the electric motor is rotatably journaled, by means of a bearing arrangement, in the electric motor. A pump shaft of the pump, which is securely connected to the rotor of the pump, is rotationally journaled in the pump with the help of a further bearing arrangement. To connect the shaft to the pump shaft, a coupling is provided.

Thus, conventional pump-motor units have at least two bearing arrangements, as well as a coupling, leading to high development and manufacturing costs. Further, a configuration with multiple bearing arrangements means that one must reckon with elevated frictional losses, since each bearing position of the bearing arrangement creates a respective frictional loss. Higher frictional losses, in turn, necessitate an increase of the required motor capacity of the electric motor, for any given pump capacity.

SUMMARY OF THE INVENTION

The object of the present invention is therefore to furnish a pump-and-motor unit which is cost-effective and efficiently configured.

The object is achieved with a pump-motor unit wherein the pump has a first rotor and a first housing, the motor is an electric motor having a second rotor, and the first and second rotors are rotationally coupled at a common shaft, so that rotation of the electric motor rotor is transmitted, via the common shaft, to drive the rotor of the pump. Advantageous embodiments with effective and non-trivial refinements of the invention are set forth in the following description.

The pump-motor unit has a motor and a pump, the pump having a first rotor and a first housing, the motor being an electric motor which has a second rotor, a stator, and a second housing.

The first rotor is, at least partially, coupled for rotation with the second rotor, in order to enable transmitting a rotation of the second (motor) rotor to the first (pump) rotor.

The use of a common shaft, which is at least partially connected to the first rotor, to make a connection between the first and second rotors, makes possible a cost-effective and efficient pump-motor combination. In contrast to prior art combinations, which needed two shafts, the pump-motor combination of the present invention needs only a single shaft.

Reduced manufacturing cost follows directly from the reduction in component count, since providing a second shaft is no longer necessary. Further, due to using a single shaft, there is an additional cost saving because the bearing configuration is more cost-effective. Generally, each rotatable shaft needs at least two bearings. Therefore, the prior art structures with two shafts need, for reliable operation, at least four bearings. Thus, reducing the number of shafts required automatically reduces the number of bearings, so the pump-motor unit is even more cost-effective.

The reduction in the bearing count leads to a reduction in friction losses since, during operation, each bearing contributes to the aggregate friction loss. This means that, with the pump-motor unit of the present invention, the same pump capacity or rating can be achieved using a smaller-capacity motor, thereby achieving an efficient pump-motor combination. Thus, the electric motor, and the complete pump-motor unit, can be made smaller and compacter, compared to those of the prior art.

A further advantage is the provision of a compact pump-motor unit, since the count of bearings is reduced, and the pump-motor unit, at least in its axial dimension, can be made compactly.

A further saving measure or cost reduction is the elimination of a coupling, which would otherwise be needed to connect two shafts together.

A further advantage, beyond the cost-effective manufacture of the pump-motor unit, is an extension of the service life of the pump-motor unit since, due to the reduction in component count, there are fewer components which are vulnerable to failure or breakage.

According to a preferred embodiment of the invention, the first rotor, which is at least partially connected to the shaft, and/or the second rotor, are coupled by press-fitting to the shaft. A force-locking coupling in the form of press-fitting or press-coupling connection between the rotors and the shaft has advantages over other types of connections. A secure connection can be created, in a simple manner, with the aid of a press-on connection. In contrast to a screw connection, no additional fastening elements are needed.

Under appropriate circumstances, this connection can be undone by a corresponding application of force; during creation of the press-fit connection, releasibility by application of a predetermined amount of force can be engineered-in. Such possible releasibility is an advantage over a bonded connection, since that would form a non-releasable connection between the rotors and the shaft.

According to a further embodiment, the shaft is radially journaled by using a first radial bearing and a second radial bearing, the first rotor being arranged between the first radial bearing and the second radial bearing. For radial support of the shaft, associated with the rotors, two radial bearings are provided.

These two radial bearings provide a radially secured positioning of the shaft within the pump-motor unit. The advantage of the positioning of the first rotor between the two radial bearings is the achievement of a shaft which has little to no bowing, and thus a pump-motor unit with minimized wear, since such a positioning of the rotors and of the radial bearings enables a rotation-dynamically imbalance-reduced system, whose bearing loading is minimal.

Due to the placement of the first rotor between the two radial bearings, the second rotor can be mounted on a side of the shaft opposite that of the first rotor, so that one of the two radial bearings is positioned between the first rotor and the second rotor. Thus a rotation system is formed having, along the shaft, a serial arrangement of a bearing-rotor pair. The first rotor, positioned between the two radial bearings, is to be arranged spaced from the two radial bearings such that its mass causes a bowing of the shaft, which can be compensated by corresponding positioning of the second rotor as a function of its mass, since one of the two radial bearings is located between the two rotors. By contrast, if both rotors were to be arranged between the two radial bearings, this would lead to severe bowing of the shaft which, due to the so-called "edge-carrying" effect adjacent the radial bearings, would subject the shaft to increased probability of failure. The same negative effect would occur with the positioning of both radial bearings between the two rotors. Thus, due to the positioning of the first rotor between the two radial bearings, a wear-minimizing pump-motor unit structure is cost-effectively achieved.

To the extent that the first radial bearing and/or the second radial bearing is implemented as a slide or plain bearing, a further cost-favorable manufacture of the pump-motor unit can be achieved, since slide bearings can be made more economically than rolling bearings.

According to a further embodiment, the first housing has a first housing segment and a second housing segment, wherein the first housing segment serves as the first radial bearing and the second housing segment serves as the second radial bearing. Thus, both radial bearings are implemented in the pump housing, and radial bearing support of the shaft in the electric motor becomes unnecessary. Thereby, one can create a compact pump-motor unit whose axial extent is relatively short, since one need not allocate corresponding space for arrangement of the radial bearings in the electric motor and, on a pump-remote side the electric motor, one can directly attach a control electronics module for controlling the pump-motor unit.

According to a further embodiment, the first housing segment is formed as a housing cover of the pump, which advantageously simplifies assembly of the radial bearing. The first radial bearing can be formed, starting from an inner surface of the cover, particularly from a first-rotor-facing surface of the cover, as an axial extension of the first housing, and can be inserted into the cover, e.g. by press-fitting. Further, the building-in of the second radial bearing is substantially simplified, since that second radial bearing can similarly be implemented as a first-rotor-receiving inner region of the housing.

According to a further embodiment, the radial bearings are formed of an aluminum-containing material. Aluminum-containing materials and aluminum alloys recommend themselves due to their relatively low weight, yet simultaneous high strength. As a function of the alloy composition, one can thus obtain high strength in the radial bearings. Especially when the radial bearings are implemented as slide or plain bearings, the bearing friction properties are favorable and, due to the high strength, the wear risk is reduced. The aluminum alloy material AlSi10Mg has proven itself to be particularly advantageous.

For further component-count-reduction and thus cost-reduction in the pump-motor unit, it is advantageous if the first rotor serves for axial journaling of the shaft. Thus, in a simple manner, one can dispense with a further component, in the form of an axial bearing.

Advantageously, the first housing is configured such that it limits a possible motion of the first rotor in one axial direction of the shaft, or in both axial directions of the shaft, in order to thus carry out the function of axially journaling the shaft. The first rotor is positioned, in a limiting manner, at an inner wall of the first housing. Axial displacement of the first rotor, which would tend to impair the functioning of the pump-motor unit, can be avoided by suitable configuration of the housing inner wall (preferably formed in the housing cover), so that the first rotor may abut the inner wall. Thus, the inner wall has the function of a stop. Axial displacement of the first rotor in a direction away from the housing cover can be avoided by a possible placement of the first rotor against the first housing. Thus, the first housing provides a stop which limits axial movement of the first rotor.

According to a further feature of the invention, a first end of the shaft, and a second (opposing) end thereof, extend outward beyond the first housing. The advantage of having these ends projecting, with respect to the first housing, is to be seen in how an operationally-reliable assembly of the pump-motor unit is carried out.

For example, in the course of making the pump-motor unit, first the first rotor of the pump is joined to the shaft by press-fitting. The shaft is then placed in the second housing segment, with both ends extending outward of the second segment. Subsequently, the housing cover is shoved over the shaft until merely enough space is left, between the first rotor and the housing cover, for rotational movement of the first rotor. Both ends of the shaft are, at the end of this assembly step, projecting beyond the first housing. Finally, the second rotor of the electric motor is secured by press-fitting to the shaft; the second rotor is thereby pushed nearly flush to the second end of the shaft. Since the press-fitting happens at a specified pressure loading, or by applying a specified force value, the first shaft end, extending beyond the first housing, is used to absorb the force, or provide a counter-force to the position-exact assembly force employed to attach the second rotor. The projection of the first end beyond the first housing permits one to avoid any damage to the connection of the shaft with the first rotor, arising from the pressing force applied during assembly with the second rotor. Thus, the need to allow, during assembly to the second rotor, the application of a predetermined pressing force to be exerted, can be compensated, without any damage to the pump resulting.

According to a further feature of implementing the invention, namely a friction-minimized pairing of the radial bearing and the shaft, the shaft is composed of steel.

The implementation of the pump-motor unit as a "wet-runner" has the advantage that the radial bearings (provided for journaling of the shaft) and the axial bearing can be supplied in a simple manner with lubricant, since the required lubricant can flow into and out of the pump. Thereby, a particularly long service life of the pump-motor unit is achieved.

According to a further feature, the pump is implemented as a "gerotor" pump which, in comparison to other conveying pumps at the same throughput, represents a cost-effective alternative, and which permits axial forces to be particularly well taken up by the pump rotor. In gerotor pumps, the outer hollow wheel behaves like a slide bearing and, over a wide operating range, there is a positive fluid friction relationship among the components.

According to a further embodiment of the pump-motor unit of the invention, at least a portion of the shaft, between the first housing and the second rotor, is free. This has the advantage that the pump-motor unit can be manufactured in a cost-saving modular structure, since a rotor packet for the electric motor can be chosen that has a length matched to that of the pump-motor unit, in which it will be used.

Further advantages, features, and details of the invention will be apparent from the following description of preferred embodiments and from the drawing figures. The features, and feature combinations, described above, and the features and feature combinations disclosed in the following detailed description and accompanying drawings are usable, not just in the disclosed combination(s) but also in other combinations, or individually, without departing from the framework of the invention. Identical or identically-functioning elements are designated with identical reference numbers. For clarity of depiction, the elements may not be tagged in all the figures with their reference numbers, but their relative arrangement and functions are not lost by this.

BRIEF FIGURE DESCRIPTION

DETAILED DESCRIPTION

Figure 1:
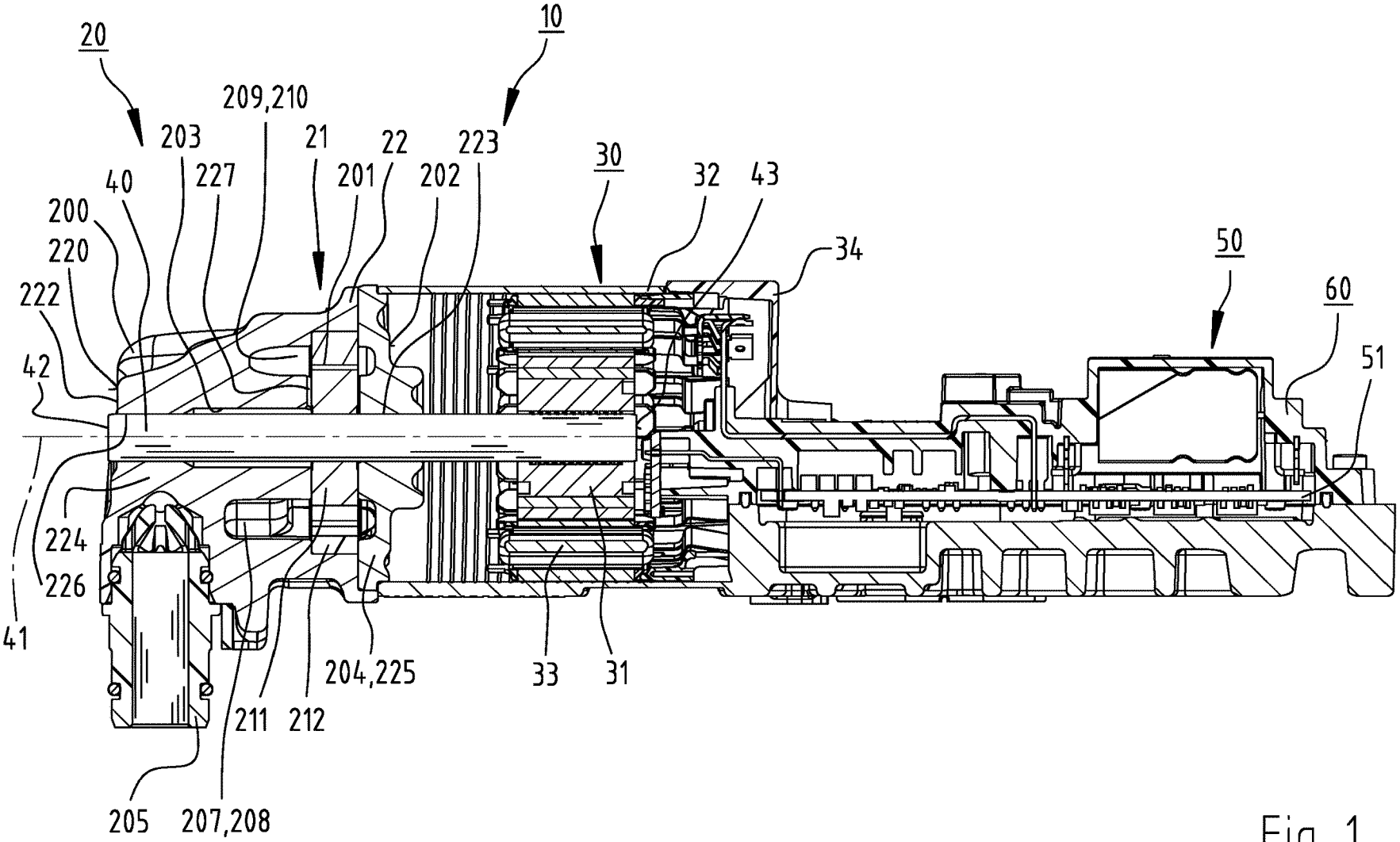
FIG. 1 is a longitudinal section through the pump-motor unit of the present invention, together with the electronic controls of the motor.

A pump-motor unit of the present invention is constructed as shown in FIG. 1. The pump-motor unit 10 includes a pump 20 which, in this embodiment, is implemented as a gerotor pump.

Further, the pump-motor unit 10 includes a motor 30, which is implemented in the form of an electric motor, with a control module 50.

The pump-motor unit 10 is in the form of a secondary oil pump.

Figure 2:
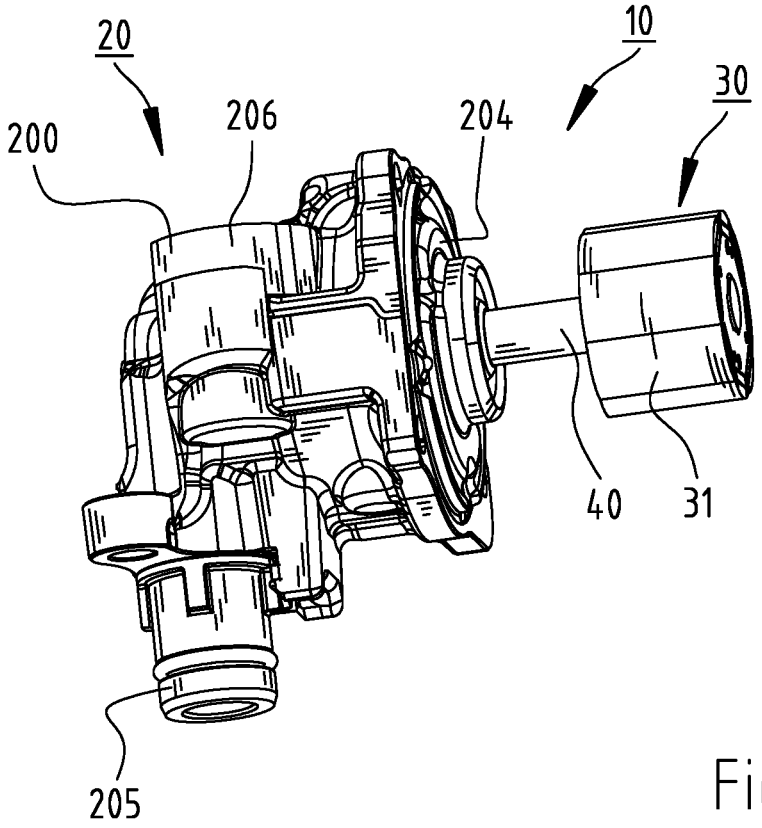
FIG. 2 is a perspective view of the pump-motor unit.

FIG. 2 shows the pump-motor combination 10 in a perspective view.

Figure 3:
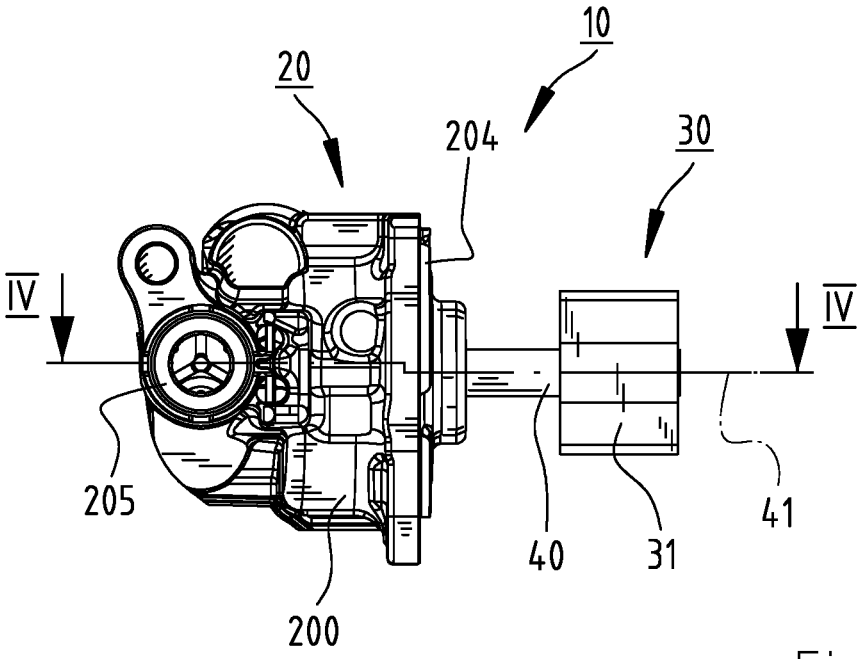
FIG. 3 is a side view of the pump-motor unit of FIG. 2.

FIG. 3 shows the pump-motor combination 10 in a side view.

Figure 4:
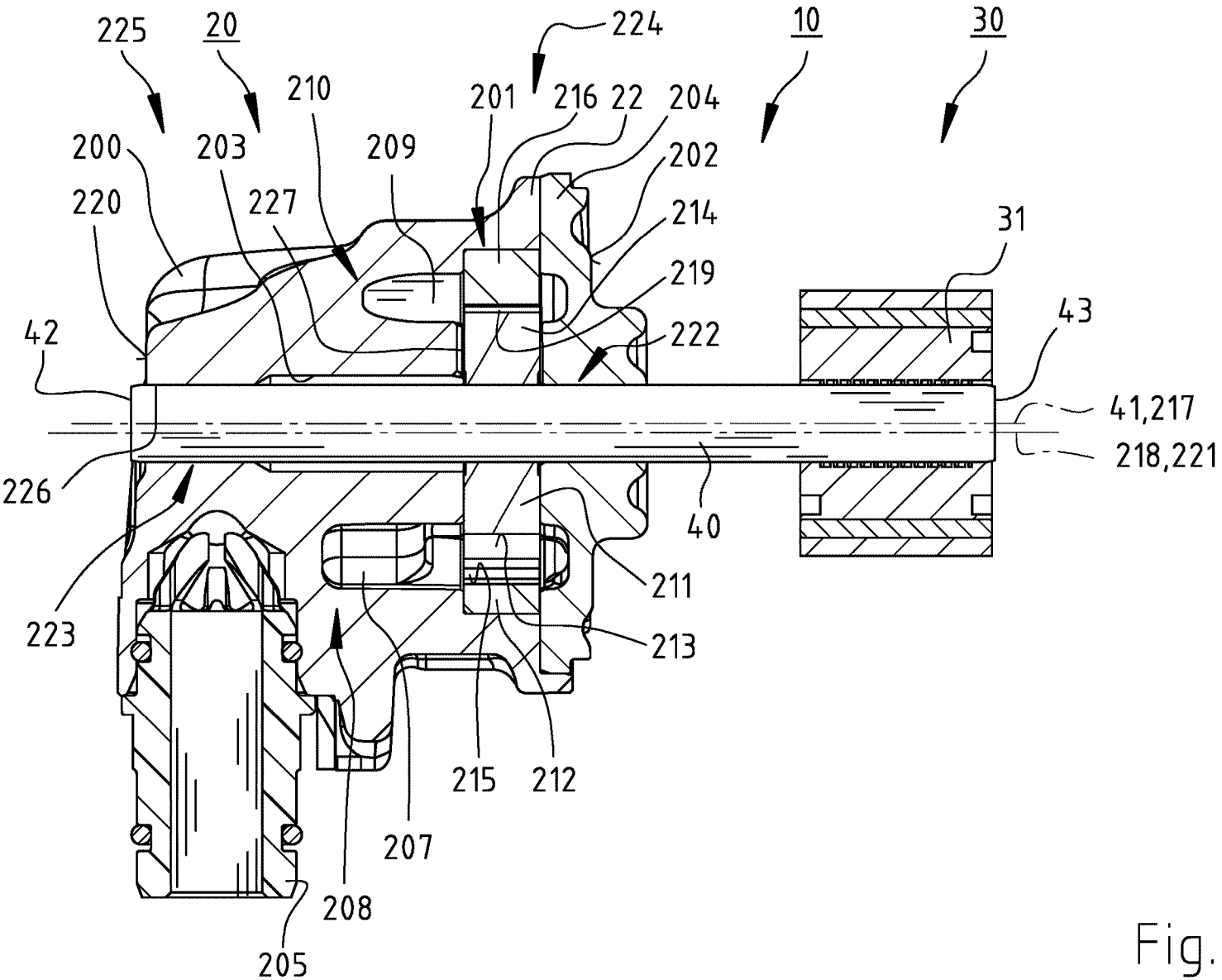
FIG. 4 is a sectional view along section line IV-IV of the pump-motor unit of FIG. 3.

FIG. 4 is a sectional view of the pump 20 (left) and of the electric motor 30 of the pump-motor combination 10 of the invention.

Pump 20 has a first rotor 21 with a first rotor part 211 and a second rotor part 212 which surrounds the first rotor part 211; the first rotor part 211 is received therein. The rotor parts 211, 212 have annular shapes. An outer circumferential surface 213 of first rotor part 211 is formed with a first plurality of teeth 214 in the form of outer toothing, and an inner circumferential surface 215 of second rotor part 212 is formed with a second plurality of teeth 216, in the form of inner toothing. During operation of the pump 20, these teeth engage with each other. The aforementioned pump rotor 21 is arranged inside a pump stator 22 which, in the embodiment shown, is formed integrally with a first housing 200 of pump 20, which thus serves as a pump chamber housing.

The first housing 200 has a circular-cylindrical depression 201, defining a chamber in which the first rotor 21 is rotatably mounted and is driven for rotation by the shaft 40 of electric motor 30.

Shaft 40 has a rotation axis 41. First rotor part 211 is securely connected for rotation with shaft 40; a connection in the form of a press-fit is formed between first rotor part 211 and shaft 40. Electric motor 30 is arranged opposite a facing side 202 of first housing 200. Shaft 40 is rotatably received in a reception opening 203 defined in first housing 200.

In this embodiment, reception opening 203 is formed as a bore and extends axially along rotation axis 41. A first rotation axis 217 of first rotor part 211 is arranged, coaxial with rotation axis 41.

Shaft 40 is shaped to extend outward of first housing 200; a first end 42 of shaft 40 and a second end 43 of shaft 40 project outward of first housing 200, in such a manner that shaft 40 extends completely through chamber 201.

A second rotor 31 of electric motor 30 is, at the second end 43 of shaft 40, connected for rotation with shaft 40. Between the first rotor 21 and the second rotor 31, a housing cover 204 of first housing 200 is arranged. The electric motor 30 has a second housing 32, depicted in FIG. 1, which receives second rotor 31 and a stator 33 which surrounds second rotor 31.

First rotor 21 is arranged in chamber 201; first rotor part 211 is oriented coaxial with shaft 40 on the pump-side portion of shaft 40.

On a back side 220, remote from front side 202, of first housing 200 are an inlet or suction port 205 and an outlet or exhaust port 206, as shown in FIG. 2. The inlet port 205 is connected via an inlet chamber 209, formed as a part-circular recess in first housing 200, with an inlet region 210 of chamber 201, while analogously the outlet port 206 is connected via an exhaust chamber 207, formed as a part-circular recess in first housing 200, to an exhaust or expelling region 210 of chamber 201. The inlet chamber 209 is preferably arranged diametrically opposite the exhaust chamber 208.

However, a differing arrangement is also possible, for example, an angular spacing of about 150° between the chambers, the spacing being measured between the centers of the chambers.

Second rotor part 212, which surrounds first rotor part 211, and thus is configured as an external rotor, is rotatably mounted in cylindrical chamber 201, essentially coaxial with chamber 201.

A longitudinal axis 221 of chamber 201 corresponds to second rotation axis 218, and is parallel to the first rotation axis 217 corresponding to rotation axis 41. It is further to be noted that the inner toothing of second rotor part 212 has more teeth than the outer toothing of the first rotor part 211 which is arranged eccentrically with respect to the second rotor part 212.

A rotation of first rotor part 211 leads, due to the engagement between the teeth of first rotor part 211 and of second rotor part 212, to co-rotation of second rotor part 212. The partially-engaging teeth of the first plurality of teeth 214 and of the second plurality of teeth 216 are completely engaged with each other only in a particular angular range. In an exactly opposing angular range, the first plurality of teeth 214 and the second plurality of teeth 216 are spaced from each other and are not engaged with each other.

The rotation of first rotor 21 leads to a so-called "overtaking" in the rotation direction of the second plurality of teeth 216 by the first plurality of teeth 214. During rotation, there arises, between two adjacent respective opposing teeth of the first rotor part 211 and of the second rotor part 212, a interstitial space or volume 219, having a regularly alternating size. As soon as, due to the rotation, the engagement between the respective opposing teeth of first rotor part 211 and second rotor part 212 is released, interstitial space 219 reaches a maximal size. Upon further rotation, the size of interstitial space 219 declines, starting with a partial engagement of the teeth of first rotor part 211 and second rotor part 212, and leading to full engagement between these teeth. As soon as the full engagement is formed, the interstitial space 291 ceases.

During the rotation phase of the growth of interstitial space 219, this space moves past the inlet port 209 so that, via the suction channel 205, hydraulic medium is sucked into interstitial space 209. During the rotation phase of the declining volume of interstitial space 219, this space moves past the exhaust port 207, so that hydraulic medium is fed, via the exhaust port 207, to outlet connection 205 with elevated pressure.

In accordance with the invention, the first rotor part 211 and the second rotor 31 are secured for rotation with the common shaft 40, in order to enable transmission of rotation of the second rotor 31 to the first rotor 21. Second rotor 31 is preferably connected by press-fitting to shaft 40, so that they rotate together.

Shaft 40 is radially supported in housing 200 by means of a slide bearing. There is a first radial bearing 222 in housing cover 204 of housing 200, and a second radial bearing 223 in a second segment 225 (at back side 220) of housing 200. Thus, first rotor 21 is arranged between first radial bearing 222 and second radial bearing 223. Alternatively, radial bearings 222, 223 could be implemented as ball bearings.

Axial bearing support, which limits an axial motion of shaft 40 along the rotation axis 41, is carried out with the help of first rotor 21, which is axially limited in a first housing segment 224 which, in this embodiment, is implemented as housing cover 204. Thus, first housing 200 serves for axial support and mounting of shaft 40.

In order to reduce friction losses, the axial bearings 222, 223 are composed of an aluminum-containing material, preferably the alloy AlSi10Mg. The formation of shaft 40 of steel results in a favorable, particularly low-friction pairing of the components 224, 225, 40 which are in contact with each other.

The pump-motor unit 10 is implemented as a so-called "wet runner" or "wet-dial" unit and is arranged in an oil pan (FIG. 6) of a transmission or gearbox (not shown in detail). It serves as an additional oil pump, or as a secondary oil pump, for the transmission, to the extent that a main oil pump (FIG. 6) is inactive. Via the inlet connection 205, during operation of the secondary oil pump, oil is sucked from the oil pan, compressed in the pump 20, and fed via the pressure outlet 206 to the transmission, which is connected, directly or indirectly, via an oil conduit with the pressure outlet 206.

A control electronics unit 51 of the control apparatus 50 is connected on a pump-remote side of the pump-motor unit 10.

The control apparatus has a third housing 60.

The implementation as a "wet-runner" facilitates lubrication oil supply to the bearings 222, 223. A through-passage opening 226 (formed starting at receiving opening 203, which extends completely through first housing 200), enables in- and out-flow of the lubrication oil in pump 20; thereby, the bearings 222, 223 and the first rotor part 211 provided for axial support, can be provided with lubricant. Similarly, lubricant entering via opening 226 passes via the pump into the electric motor 30 and exits at a motor cover formed at a pump-remote end of electric motor 30, and vice versa. Preferably, the suction regions 209, 210 on the front side of the pump rotors 211 212 and the receiving opening 203 are in fluid communication via a fluid channel 227, in order to make possible, via suction regions 209, 210, a supply of oil to the receiving opening 203, and to thereby assure a better lubrication of shaft 40.

Figure 5:
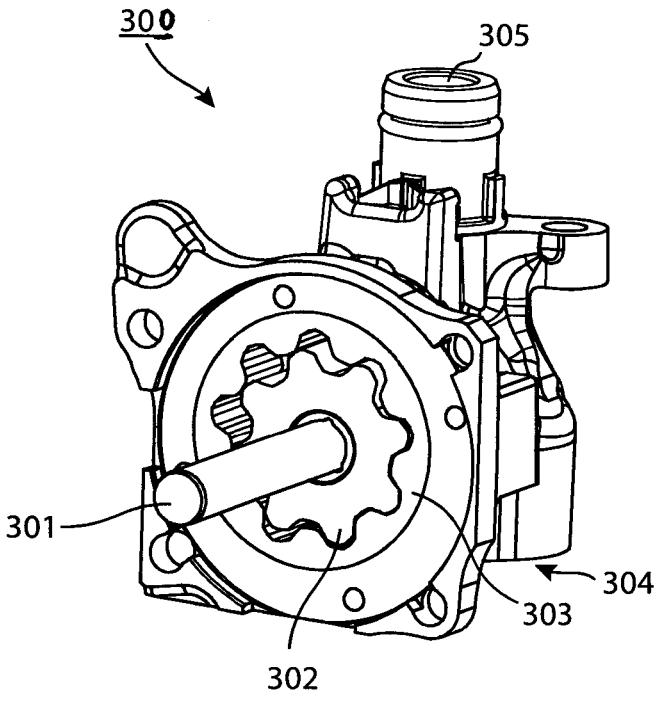
FIG. 5 is a perspective view of a gerotor pump embodiment of the invention.

FIG. 5 illustrates schematically the structure of a gerotor pump 300. The pump rotor has an inner toothed wheel 302 and an outer toothed ring 303, whose inward-pointing teeth mesh with the outward-pointing teeth of inner wheel 302. Inner wheel 302 and outer ring 303 are eccentrically mounted with respect to each other, and have differing respective numbers of teeth. Therefore, inner wheel 302 and outer ring 303 turn at different respective rotation speeds, so that, during rotation, the size of the voids or interstitial spaces between the respective teeth fluctuate between a maximum volume and a minimum volume.

Pump 300 has a fluid inlet 304 and a fluid outlet 305. Fluid inlet 304 is in fluid communication (via a channel, not shown) with the facing sides of inner wheel 302 and of outer ring 303 at a region where, for a predetermined rotation direction, the void size decreases, thereby creating excess pressure, which expels the fluid to be conveyed.

Figure 6:
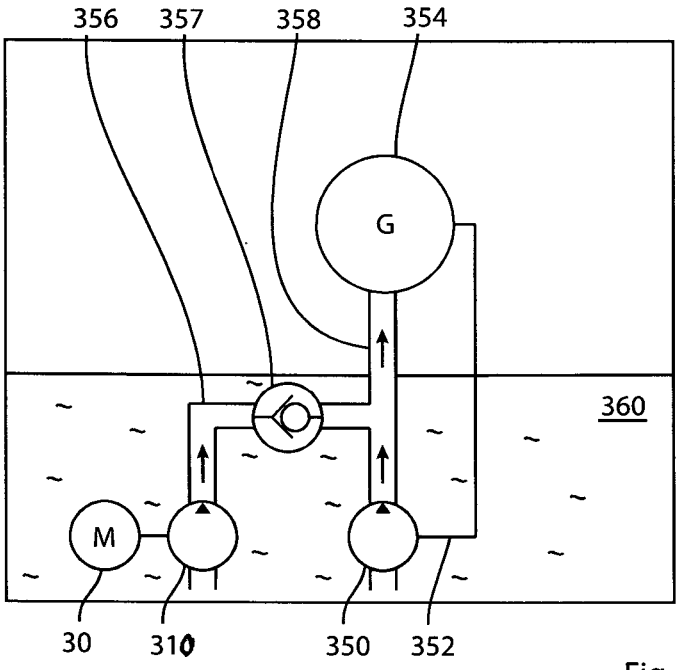
FIG. 6 is a schematic illustration of a transmission with a pump for transmission oil.

FIG. 6 shows a possible schematic structure of a transmission apparatus 370 with a schematically indicated housing 372 in which, at the bottom, transmission oil 360 is provided. The actual mechanical transmission gears 354 must, in operation, be lubricated by the transmission oil 360. For this purpose, a first transmission oil main pump 350 is provided, which is mechanically driven, from transmission 354, via a mechanism 352, in order to supply transmission oil 360 via a conduit 358 to the transmission 354. However, transmission oil main pump 350 only functions when transmission 354 is moving. In a stationary state of transmission 354, transmission oil main pump 350 is not active, and lubrication of transmission 354 is not assured, especially upon start-up of transmission 354. Therefore, the supplemental or auxiliary oil pump 310, driven by electric motor 30, is provided. It can, as needed, pump oil 360 via conduit 356 and non-return valve 357 into conduit 358, and thence into transmission 354. The non-return value 357 is provided to prevent flow of transmission oil from main pump 350 into supplemental pump 310. The transmission oil 360 applied to transmission 354 subsequently flows back down into the oilpan, and can be later pump back up again. Alternatively, pump 310 could naturally be installed as the main transmission oil pump 350.

Those having ordinary skill in the fluid pumping art will understand that many variations and modifications are possible, within the scope of the inventive concept. Therefore, the invention is not limited to the specific embodiments described above, but rather is defined by the following claims.

What is claimed is:

1. A pump-motor unit, comprising a motor (30);

a pump (20) having a first rotor (21) and a first housing (200);

said pump (20) being configured as a gerotor pump;

said first housing (200) having an inlet port (205) and an outlet port (206), said inlet port (205) and said outlet port (206) being connected to said pump (20);

said motor (30) being an electric motor and having a second rotor (31), a stator (33) and a second housing (32);

wherein said first rotor and said second rotor (31) are rotationally coupled at a common shaft (40), so that a rotation of said second rotor (31) is transmitted via said shaft (40) to said first rotor (21);

wherein said shaft (40) is rotationally mounted with a first radial bearing (222) and a second radial bearing (223), said first housing (200) has a first housing portion (224) and a second housing portion (225), said first housing portion (224) is configured to provide a housing cover (204) for said pump (20) having an radial inner surface, said first radial bearing (222) comprising said radial inner surface of the housing cover (204); and wherein said motor (30) and said pump (20) are spaced apart in a longitudinal direction of the shaft (40) and separated by said second housing portion (225), said second housing portion (225) in contact with said second housing (32) forming a cover for the motor (30), wherein said first radial bearing (222) and said second radial bearing (223) are arranged respectively in said first housing portion (224) and said second housing portion (225).

2. The pump-motor unit of claim 1, wherein said first rotor (21) is, at least partially, secured to the shaft (40) and the second rotor (31) is press-fitted to the shaft (40).

3. The pump-motor unit of claim 2, wherein said shaft (40) is journalled for rotation using said first radial bearing (222) and said second radial bearing (223), and said first rotor (21) is located axially between said first and second radial bearings.

4. The pump-rotor unit of claim 3, wherein at least one of said first radial bearing and said second radial bearing is formed as a plain bearing.

5. The pump-motor unit of claim 1, wherein said shaft (40) is journalled for rotation using a first radial bearing (222) and said second radial bearing (223), and said first rotor (21) is located axially between said first and second radial bearings.

6. The pump-rotor unit of claim 5, wherein at least one of said first radial bearing and said second radial bearing is formed as a plain bearing.

7. The pump-rotor unit of claim 6, wherein said first housing portion (224) serves as said first radial bearing and said second housing portion (225) serves as said second radial bearing.

8. The pump-motor unit of claim 1, wherein said first and second radial bearings (222, 223) comprise an alloy containing aluminum.

9. The pump-motor unit of claim 8, wherein said alloy is AlSi10Mg.

10. The pump-motor unit of claim 1, wherein said first rotor (21) provides radial bearing support for said shaft (40).

11. The pump-motor unit of claim 10, wherein said first housing (200) is configured to limit movement, of said first rotor (21) along a longitudinal axis of said shaft (40), in at least one of two possible directions, thereby serving for axial mounting of said shaft (40).

12. The pump-motor unit of claim 1, wherein said shaft (40) has a first shaft end (42) and a second shaft end (43) remote from said first shaft end (42), and said ends (42, 43) project axially outward of said first housing (200).

13. The pump-motor unit of claim 1, wherein said shaft (40) comprises a steel alloy.

14. The pump-motor unit of claim 1, wherein a pump stator (22) is formed integrally with said first housing (200).

15. The pump-motor unit of claim 1, wherein, between said first housing (200) and said second rotor (31), at least one portion of said shaft (40) is free and unsupported.

16. The pump-motor unit of claim 1, further comprising a controller which actuates the pump-motor (310) when a main oil pump (350) of an associated transmission (354) is not operating.

17. A pump-motor unit, comprising a motor (30);

a pump (20) having a first rotor (21) and a first housing (200);

said pump (20) being configured as a gerotor pump;

a through-passage opening (226) extending completely through said first housing (200), said motor (30) being an electric motor and having a second rotor (31), a stator (33) and a second housing (32), wherein said first rotor and said second rotor (31) are rotationally coupled at a common shaft (40), so that a rotation of said second rotor (31) is transmitted via said shaft (40) to said first rotor (21), wherein said shaft (40) is rotationally mounted with a first radial bearing (222) and a second radial bearing (223), said first housing (200) has a first housing portion (224) and a second housing portion (225), said first housing portion (224) is configured to provide a housing cover (204) for said pump (20) having an radial inner surface, said first radial bearing (222) comprising said radial inner surface of the housing cover (204), wherein said shaft (40) extends through said through-passage opening (226), and wherein said through-passage opening (226) allows passing of a lubricant between said first rotor (21) and said second rotor (31) to adapt said pump-motor unit for wet-dial operation, and wherein said motor (30) and said pump (20) are spaced apart in a longitudinal direction of the shaft (40) and separated by said second housing portion (225), said second housing portion (225) in contact with said second housing (32) forming a cover for the motor (30), wherein said first radial bearing (222) and said second radial hearing (223) are arranged respectively in said first housing portion (224) and said second housing portion (225).

18. The pump-motor unit of claim 17, which is arranged in an oil pan.

19. The pump-motor unit of claim 17, wherein the pump (20) is a hydraulic pump.

20. The pump-motor unit of claim 1, further comprising a through-passage opening (226) extending completely through said first housing (200);

wherein said shaft (40) extends through said through-passage opening (226), and said through-passage opening (226) allows passing of a lubricant between said first rotor (21) and said second rotor (31) to adapt said pump-motor unit wet-dial operation.

* * * * *